US012270005B2

(12) United States Patent
Nelson et al.

(10) Patent No.: US 12,270,005 B2
(45) Date of Patent: Apr. 8, 2025

(54) LUBRICANT CONTAINING POLYPHOSPHATE ADDITIVES

(71) Applicant: CHEVRON ORONITE COMPANY LLC, San Ramon, CA (US)

(72) Inventors: Kenneth D. Nelson, Napa, CA (US); Jonathan A. Moore, San Francisco, CA (US)

(73) Assignee: CHEVRON ORONITE COMPANY LLC, San Ramon, CA (US)

( * ) Notice: Subject to any disclaimer, the term of this patent is extended or adjusted under 35 U.S.C. 154(b) by 0 days.

(21) Appl. No.: 18/264,000

(22) PCT Filed: Mar. 16, 2022

(86) PCT No.: PCT/IB2022/052373

§ 371 (c)(1),
(2) Date: Aug. 2, 2023

(87) PCT Pub. No.: WO2022/195502

PCT Pub. Date: Sep. 22, 2022

(65) Prior Publication Data

US 2024/0110122 A1 Apr. 4, 2024

Related U.S. Application Data

(60) Provisional application No. 63/162,418, filed on Mar. 17, 2021.

(51) Int. Cl.

| | |
|---|---|
| ***C10M 169/04*** | (2006.01) |
| ***C10M 105/02*** | (2006.01) |
| ***C10M 125/24*** | (2006.01) |
| ***C10M 129/24*** | (2006.01) |
| ***C10M 137/10*** | (2006.01) |
| ***C10M 141/10*** | (2006.01) |
| *C10N 10/04* | (2006.01) |
| *C10N 20/02* | (2006.01) |
| *C10N 30/00* | (2006.01) |
| *C10N 30/06* | (2006.01) |
| *C10N 40/25* | (2006.01) |
| *C10N 50/00* | (2006.01) |

(52) U.S. Cl.

CPC ..... *C10M 169/04* (2013.01); *C10M 105/02* (2013.01); *C10M 125/24* (2013.01); *C10M 129/24* (2013.01); *C10M 137/10* (2013.01); *C10M 141/10* (2013.01); *C10M 2201/085* (2013.01); *C10M 2203/04* (2013.01); *C10M 2207/08* (2013.01); *C10M 2223/045* (2013.01); *C10M 2290/00* (2013.01); *C10N 2010/04* (2013.01); *C10N 2020/02* (2013.01); *C10N 2030/06* (2013.01); *C10N 2030/52* (2020.05); *C10N 2040/25* (2013.01); *C10N 2050/00* (2013.01)

(58) Field of Classification Search

CPC ..... C10M 169/04; C10M 105/02; C10M 125/24; C10M 129/24; C10M 137/10; C10M 141/10; C10M 2201/085; C10M 2203/04; C10M 2207/08; C10M 2223/045; C10M 2290/00; C10M 2203/1025; C10M 2207/021; C10M 2207/023; C10M 2207/126; C10M 2207/282; C10M 2215/064; C10M 2215/28; C10M 2219/044; C10M 2223/04; C10M 2223/043; C10M 2223/10; C10M 137/08; C10N 2010/04; C10N 2020/02; C10N 2030/06; C10N 2030/52; C10N 2040/25; C10N 2050/00; C10N 2030/45

See application file for complete search history.

(56) References Cited

U.S. PATENT DOCUMENTS

| | | | |
|---|---|---|---|
| 4,268,404 A | 5/1981 | Ahlgrim et al. | |
| 8,945,316 B2 * | 2/2015 | Beck | G03F 1/82 134/42 |

FOREIGN PATENT DOCUMENTS

| | | | |
|---|---|---|---|
| CN | 104403747 A | * | 3/2015 |
| CN | 106467828 A | * | 3/2017 |
| CN | 108410550 | | 8/2018 |

OTHER PUBLICATIONS

International Search Report, issued on Jun. 28, 2022, during the prosecution of International Application No. PCT/IB2022/052373.
Written Opinion of the International Searching Authority, issued on Jun. 28, 2022, during the prosecution of International Application No. PCT/IB2022/052373.

* cited by examiner

*Primary Examiner* — Taiwo Oladapo

(57) ABSTRACT

A lubricating oil composition is described. The composition includes a major amount of a base oil of lubricating viscosity and a polyphosphate-based dispersion. The dispersion includes an ammonium polyphosphate and a dispersing agent.

15 Claims, No Drawings

LUBRICANT CONTAINING POLYPHOSPHATE ADDITIVES

TECHNICAL FIELD

This disclosure relates to lubricating oil additive compositions and lubricating oil compositions containing the same. More specifically, the present invention provides polyphosphate-based anti-wear agents that produce reduced levels of ash.

BACKGROUND

Conventional anti-wear agents (e.g., zinc dithiophosphates) are often used in lubricating oils to reduce the risk of metal-to-metal contact in engines. However, engine combustion in the presence of metal-containing lubricant additives can produce ash.

Build-up of ash leads to a number of well-known issues including blockage of engine particulate filters leading to adverse outcomes such as lowering of fuel economy. Therefore, it is desirable to provide new lubricant additives that are ashless or produce less ash compared to conventional lubricant additives.

SUMMARY

In one aspect, there is provided a lubricating oil composition comprising: a major amount of a base oil of lubricating viscosity; and a polyphosphate-based dispersion comprising an ammonium polyphosphate and a dispersing agent.

In another aspect, there is provided a lubricating oil composition comprising: a major amount of a base oil of lubricating viscosity; an ammonium polyphosphate; and a dispersing agent.

In a further aspect, there is provided a method of operating an internal combustion engine, the method comprising: lubricating the engine with a lubricating oil comprising: a major amount of a base oil of lubricating viscosity; an ammonium polyphosphate; and a dispersing agent.

DETAILED DESCRIPTION

Introduction

In this specification, the following words and expressions, if and when used, have the meanings ascribed below.

The term "oil soluble" means that for a given additive, the amount needed to provide the desired level of activity or performance can be incorporated by being dissolved, dispersed or suspended in an oil of lubricating viscosity. Usually, this means that at least 0.001% by weight of the additive can be incorporated in a lubricating oil composition. The term "fuel soluble" is an analogous expression for additives dissolved, dispersed or suspended in fuel.

A "minor amount" means less than about 50 wt % of a composition, expressed in respect of the stated additive and in respect of the total weight of the composition, reckoned as active ingredient of the additive.

A "major amount" means greater than about 50 wt % of a composition expressed in respect of the stated additive and in respect of the total weight of the composition, reckoned as active ingredient of the additive.

An "engine" or a "combustion engine" is a heat engine where the combustion of fuel occurs in a combustion chamber. An "internal combustion engine" is a heat engine where the combustion of fuel occurs in a confined space ("combustion chamber"). A "spark ignition engine" is a heat engine where the combustion is ignited by a spark, usually from a spark plug. This is contrast to a "compression-ignition engine," typically a diesel engine, where the heat generated from compression together with injection of fuel is sufficient to initiate combustion without an external spark.

The present invention provides a lubricating oil composition comprising a major amount of base oil of lubricating viscosity and a polyphosphate anti-wear agent. A polyphosphate does not easily solubilize in oil due to its highly polar structure. Thus, the present invention further provides a dispersing agent that incorporates the polyphosphate anti-wear agent to form a polyphosphate-based dispersion in oil. In general, the effectiveness of the polyphosphate-based dispersion will depend on the degree of homogeneity of the dispersion in a lubricating oil fluid. The degree of homogeneity in dispersion can be correlated to turbidity of the polyphosphate-based dispersion.

Polyphosphate-Based Dispersion

The polyphosphate-based dispersion of the present invention comprises ammonium polyphosphate and dispersing agent. In some embodiments, the polyphosphate dispersion may be metal-free (i.e., less than about 2 ppm based on total lubricating oil composition), substantially metal-free (i.e., less than about 50 ppm based on total lubricating oil composition), zinc-free (i.e., less than about 2 ppm based on total lubricating oil composition), or substantially zinc-free (i.e., less than about 50 ppm based on total lubricating oil composition). As a result, the polyphosphate-based dispersion of the present invention will result in no ash ("ashless") or less ash compared to metal-based anti-wear agents.

In some embodiments, the polyphosphate-based dispersion may be used in combination with a metal-based anti-wear agent such as zinc dithiophosphate (secondary ZnDTP). In some embodiments, zinc dithiophosphate is present in about 0.01 wt % to 15 wt %.

According to an embodiment, the ammonium polyphosphate has the following generalized Structure I:

Structure I

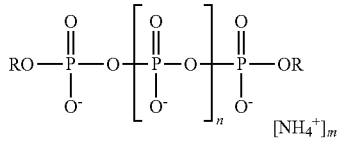

wherein R is independently a hydrogen or a hydrocarbyl group, n is an integer ranging from 1 to 1000, and m is n+2.

Because ammonium polyphosphate is typically insoluble in lubricating oil media, it is beneficial to incorporate the polyphosphate as a dispersion in the oil by mixing in a dispersing agent.

The dispersing agent may be any molecule that is capable of dispersing or distributing the ammonium polyphosphate in the lubricating oil composition. Dispersing agents are typically long amphiphilic molecules which have both a hydrophilic and a hydrophobic end. The dispersing agent is capable of forming an aggregate structure such as an emulsion in the lubricating oil composition.

The amount of dispersing agent used is typically the minimum amount that results in a stable dispersion. In particular, metal dispersing agents (e.g., metal detergents) could lead to ash production. These dispersing agents ought not to exceed about 6% of total component volume. Total surfactant should not exceed about 20% of total component volume.

Dispersing agents compatible with the present invention include known organic surfactants such as stearates, benzenesulfonates, phosphatidylcholines, alkenyl succinates, oleates, fatty alcohols, alkenyl succinimides, and the like.

The polyphosphate-based dispersions of the present invention can be prepared by any suitable means. The following describes a method of obtaining the dispersion by dehydrating a water-in-oil emulsion of either an aqueous solution of ammonium hydroxide and phosphoric acid or an aqueous solution of ammonium phosphate. Ideally, a solution is prepared having a 1:1 charge mole ratio of ammonium hydroxide to phosphoric acid.

The solution is then added to a combination of neutral oil, dispersant, and optionally a detergent and mixed with a high shear mixer (e.g., blender) to form an emulsion. The resulting emulsion is heated (140° C.) to partially dehydrate it. During dehydration of the emulsion, water will be rapidly removed at 104° C. to 108° C.

After this, nearly all process water has been eliminated. Additional water removed after this stage could be the dehydration of the hydrated phosphate oligomer. Between 110° C. to 120° C., the turbid emulsion will begin to clear before it again becomes turbid between 130° C. to 140° C. At this point, the product has reached the preferred level of dehydration and should be immediately removed from heat.

The cooled product will return to a clear and homogenous mixture at room temperature containing approximately 6.5 wt % phosphorous from the dispersed ammonium polyphosphate.

Lubricating Oil Compositions

The polyphosphate dispersions of the present disclosure are useful as additives in lubricating oils. The concentration of the dispersions of the present disclosure in the lubricating oil composition may range from 0.01 to 15 wt % (e.g., 0.1 to 10 wt %, 0.2 to 5.0 wt %, 0.5 to 2.0 wt %), based on the total weight of the lubricating oil composition.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group Ill base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, Ill, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

Base oils for use in the lubricating oil compositions of present disclosure are any of the variety of oils corresponding to API Group I, Group II, Group Ill, Group IV, and Group V oils, and mixtures thereof, preferably API Group II, Group Ill, Group IV, and Group V oils, and mixtures thereof, more preferably the Group Ill to Group V base oils due to their exceptional volatility, stability, viscometric and cleanliness features.

Typically, the base oil will have a kinematic viscosity at 100° C. (ASTM D445) in a range of 2.5 to 20 $mm^2/s$ (e.g., 3 to 12 $mm^2/s$, 4 to 10 $mm^2/s$, or 4.5 to 8 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt %, such as about 0.01 to about 10 wt %.

The following illustrative examples are intended to be non-limiting.

EXAMPLES

Polyphosphate Dispersion 1

A dispersion containing ammonium polyphosphate was prepared by dehydration of oil-in-water emulsions of aqueous ammonium phosphate by heating to 139° C. over a 1.5-hour period.

The aqueous solution was prepared in a 2-liter glass beaker by stirring and heating to 80° C., a mixture 510.8 g DI water and 250.8 of ammonium phosphate until the ammonium phosphate was completely dissolved.

Oil-in-water emulsions were made by gradually adding the aqueous phase to an oil phase containing 540.3 g of Exxon 150 Neutral oil, 120.54 g of an alkenyl succinate having a molecular weight of about 1100 amu, and 51.26 g of a neutral sulfonate.

As the aqueous layer was slowly added, the solution was mixed vigorously using a high shear mixer to form a turbid emulsion. The emulsion was then partially dehydrated in a 4 L beaker equipped with a mechanical stirrer, temperature controlled hot plate, and nitrogen sweep line.

Polyphosphate Dispersion 2

A dispersed polyphosphate component was prepared according to the steps described in polyphosphate dispersion 1, except equimolar amounts of phosphoric acid and ammonium hydroxide were used in place of the ammonium phosphate solution.

Polyphosphate Dispersion 3

A dispersed polyphosphate component was prepared according to the steps described in polyphosphate dispersion 1, except the neutral sulfonate was omitted. This example contained 4.26% phosphorus. The TBN was 128 mgKOH/g.

Polyphosphate Dispersion 4

A dispersed polyphosphate component was prepared according to the steps described in polyphosphate dispersion 1, except 2-ethyl hexanol was added in place of neutral sulfonate.

Polyphosphate dispersions 1-4 all exhibited <100 NTU (nephelometric turbidity unit) indicating that stable suspensions were formed.

These polyphosphate dispersions were added to Group II paraffinic base oil at various treat rates to form comparative examples and examples as summarized in Table 1.

Comparative example 1 is Group II paraffinic base oil with no anti-wear additives.

Comparative example 2 is Group II paraffinic base oil with 1 wt % of a commercially available secondary zinc dialkyldithiophosphate.

Example 1A is Group II paraffinic base oil with 0.125 wt % of polyphosphate dispersion 1.

Example 1B is Group II paraffinic base oil with 0.25 wt % of polyphosphate dispersion 1.

Example 1C is Group II paraffinic base oil with 0.5 wt % of polyphosphate dispersion 1.

Example 1D is Group II paraffinic base oil with 1.0 wt % of polyphosphate dispersion 1.

Example 2 is Group II paraffinic base oil neutral oil with 1.0 wt % of polyphosphate dispersion 2.

Example 3 is Group II paraffinic base oil neutral oil with 1.0 wt % of polyphosphate dispersion 3.

Example 4 is Group II paraffinic base oil with 1.0 wt % of polyphosphate dispersion 4.

Electrical Contact Resistance (ECR) Measurement via MTM

Comparative examples 1 and 2 and Examples 1-4 were evaluated using a PCS Instruments Ltd., London UK, Mini-Traction Machine (MTM) tribometer. The MTM tribometer was set up to run in pin on disk mode using polished disks of 52100 steel from PCS Instruments, and a 0.25 inch stationary ball bearing, also of 52100 steel from Falex corporation, in place of a pin. The test was conducted at 100° C. for 40 minutes at 7 Newtons load at a sliding speed of 200 mm/s, following a break-in period of 5 minutes at 0.1 Newtons load and a sliding speed of 2000 mm/s.

The formation of a wear-preventative lubricating oil film can be measured by Electrical Contact Resistance (ECR). The ECR (Electrical Contact Resistance) is an add-on to the standard MTM system. The electrical resistance is measured between the disc and the upper specimen (ball, pin or roller).

An electrical potential is applied to the ball. When the upper specimen is fully separated from the lower specimen (disc), the ECR reading will be 100%. When direct metal-to-metal contact is made between the specimens, the contact will be a short circuit and the ECR reading will be 0%. A reading of a 100% indicates the formation of a fully insulating film of oil. The maximum ECR value and time required to reach 100% ECR (indicative of the formation of a lubricating oil film) is also reported in Table 1.

Comparative Example 1, which contains no additive, failed to reach 100% ECR. Similarly, Example 1A, which contains a very low dosage of the ammonium polyphosphate dispersion, failed to reach 100% ECR. Examples 1B-1D and Examples 2-4 all reached 100% ECR within a relatively short time frame, and in particular Examples 1 D and 2 showed equal film formation performance as Comparative Example 2 which contains the same dosage of a commercially available ZnDTP anti-wear additive.

TABLE 1

| Composition (wt %) | Comp. Ex. 1 | Comp. Ex. 2 | Ex. 1A | Ex. 1B | Ex. 1C | Ex. 1D | Ex. 2 | Ex. 3 | Ex. 4 |
|---|---|---|---|---|---|---|---|---|---|
| Secondary ZnDTP | 0 | 1.0 | 0 | 0 | 0 | 0 | 0 | 0 | 0 |
| Polyphosphate 1 | 0 | 0 | 0.125 | 0.25 | 0.5 | 1.0 | 0 | 0 | 0 |
| Polyphosphate 2 | 0 | 0 | 0 | 0 | 0 | 0 | 1.0 | 0 | 0 |
| Polyphosphate 3 | 0 | 0 | 0 | 0 | 0 | 0 | 0 | 1.0 | 0 |
| Polyphosphate 4 | 0 | 0 | 0 | 0 | 0 | 0 | 0 | 0 | 1.0 |
| Maximum ECR | 20 | 100 | 0 | 100 | 100 | 100 | 100 | 100 | 100 |
| Time to reach 100% ECR (seconds) | N/A | <100 | N/A | 500 | 500 | <100 | <100 | 620 | 910 |

Baseline Formulation A

Baseline Formulation A was prepared by blending together the following components to obtain an SAE 5W-30 viscosity grade lubricating oil formulation:

(a) a mixture of borated and non-borated succinimide dispersant;

(b) magnesium sulfonate detergent;

(c) calcium phenate and calcium sulfonates;

(d) an alkylated diphenylamine and hindered phenol antioxidant;

(e) a molybdenum succinimide antioxidant;

(f) conventional amounts of pour point depressant, viscosity index improver, and foam inhibitor; and (g) the balance a mixture of Group II base oils.

Comparative Example 3

Comparative Example 3 was formulated using Baseline Formulation A with the addition of 1.03 wt % of a commercially available secondary zinc dialkyldithiophosphate (ZnDTP).

Example 5

Example 5 was formulated using Baseline Formulation A with the addition of 0.77 wt % of a commercially available secondary ZnDTP and 0.31 wt % of the ammonium polyphosphate dispersion of Example 1.

Example 6

Example 6 was formulated using Baseline Formulation A with the addition of 0.52 wt % of a commercially available secondary ZnDTP and 0.625 wt % of the ammonium polyphosphate dispersion of Example 1.

Example 7

Example 7 was formulated using Baseline Formulation A with the addition of 0.26 wt % of a commercially available secondary ZnDTP and 0.94 wt % of the ammonium polyphosphate dispersion of Example 1.

Example 8

Example 8 was formulated using Baseline Formulation A with the addition of 1.25 wt % of the ammonium polyphosphate dispersion of Example 1.

Mini-Traction Machine (MTM) Evaluation

The lubricating oil compositions of Comparative example 3 and Examples 5-8 were evaluated using a PCS Instruments Ltd., London UK, Mini-Traction Machine (MTM) tribometer. The MTM tribometer was set up to run in pin on disk mode using polished disks of 52100 steel from PCS Instruments, and a 0.25 inch stationary ball bearing, also of 52100 steel from Falex corporation, in place of a pin. The test was conducted at 100° C. for 40 minutes at 7 Newtons load at a sliding speed of 200 mm/s, following a break-in period of 5 minutes at 0.1 Newtons load and a sliding speed of 2000 mm/s. Test results, in Table 2, show the wear scar generated on the ball bearing as measured with an optical microscope by conventional methods. Reported are the average wear scar from 4 test runs.

TABLE 2

| Composition (wt %) | Comp. ex. 3 | Example 5 | Example 6 | Example 7 | Example 8 |
|---|---|---|---|---|---|
| Secondary ZnDTP | 1.03 | 0.77 | 0.52 | 0.26 | 0.00 |
| Polyphosphate 1 | 0 | 0.31 | 0.625 | 0.94 | 1.25 |
| Phosphorus content (ppm) | 740 | 740 | 740 | 740 | 740 |
| Zinc content (ppm) | 810 | 610 | 410 | 200 | 0 |
| Sulfated ash (wt %) | 0.95 | 0.92 | 0.9 | 0.87 | 0.85 |
| Average Wear scar (μm) | 615 | 517 | 454 | 433 | 500 |

As shown above in Table 2, at equal phosphorus-based treat rates, Examples 5-8 containing the ashless ammonium polyphosphate dispersion shows superior anti-wear performance in view of Comparative Example 3 which contains conventional ZnDTP additive. More importantly, Examples 5-8 contain lower levels of sulfated ash than Comparative Example 3. Example 8 contains no zinc and subsequently a reduced level of sulfated ash compared to Comparative Example 3.

Baseline Formulation B

Baseline Formulation B was prepared by blending together the following components to obtain an SAE 5W-30 viscosity grade lubricating oil formulation:

(a) succinimide dispersant;

(b) calcium phenate and calcium sulfonates;

(c) an alkylated diphenylamine antioxidant;

(d) conventional amounts of pour point depressant, viscosity index improver, and foam inhibitor; and (e) the balance a mixture of Group Ill base oils.

Comparative Example 4

Comparative Example 4 was formulated using Baseline Formulation B with no zinc dialkyldithiophosphate (ZnDTP).

Comparative Example 5

A lubricating oil formulation was formed containing the same additives, base oil, and treat rates as in Baseline Formulation B, with the addition of 0.17 wt % secondary zinc dialkyldithiophosphate.

Comparative Example 6

A lubricating oil formulation was formed containing the same additives, base oil, and treat rates as in Baseline Formulation B, with the addition of 0.43 wt % secondary zinc dialkyldithiophosphate.

Example 9

A lubricating oil formulation was formed containing the same additives, base oil, and treat rates as in Baseline Formulation B, with the addition of 0.47 wt % of the ammonium polyphosphate dispersion of Example 1.

Sequence IVA Screener Test

Comparative Examples 4-6 and Example 9 were evaluated for valve train wear in a modified version of the Sequence IVA test (ASTM D 6891).

The Modified sequence IVA screener test evaluates a lubricant's performance in preventing camshaft lobe wear in an overhead camshaft engine. More specifically, the test measures the ability of crankcase oil to control camshaft lobe wear for spark-ignition engines equipped with an overhead valve-train and sliding can followers. This test is to simulate service for taxicab, light-delivery truck, or commuter vehicles.

The Sequence IVA screener test method is a 50-hour test involving 2 sets of 25 hour cycles; one cycle is run at 40° C. for 25 hours, followed by 100° C. for 25 hours. Unleaded "Haltermann KA24E Green" fuel is used. The text fixture is a KA24E Nissan 2.4-liter, water-cooled, fuel-injected engine, 4-cylinder in-line, overhead camshaft with two intake valves, and one exhaust valve per cylinder.

Average cam wear (7 position average, μm) values are reported in Table 3 below.

TABLE 3

| Component (wt %) | Comp. ex. 4 | Comp. ex. 5 | Comp. ex. 6 | Example 9 |
|---|---|---|---|---|
| ZnDTP | 0 | 0.17 | 0.42 | 0 |
| Ammonium Phosphate dispersion | 0 | 0 | 0 | 0.47 |
| Phosphorus (ppm) | 0 | 123 | 310 | 310 |
| Zinc (ppm) | 0 | 135 | 338 | 0 |
| Sulfated Ash (wt %) | 0.71 | 0.73 | 0.75 | 0.71 |
| Avg. cam wear (μm) | 186.54 | 127.88 | 35.37 | 18.41 |

Comparative Example 4 contains no anti-wear additives and shows high average cam wear. Comparative Examples 5 and 6 show lower cam wear but higher levels of sulfated ash due to the ZnDTP. In comparison, Example 9 not only demonstrates superior anti-wear performance to the formulations containing ZnDTP, but has lower levels of ash.

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby.

Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

The terms "a" and "the" as used herein are understood to encompass the plural as well as the singular.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

The foregoing description of the disclosure illustrates and describes the present disclosure. Additionally, the disclosure shows and describes only the preferred embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art. While the foregoing is directed to embodiments of the present disclosure, other and further embodiments of the disclosure may be devised without departing from the basic scope thereof, and the scope thereof is determined by the claims that follow.

The embodiments described hereinabove are further intended to explain best modes known of practicing it and to enable others skilled in the art to utilize the disclosure in such, or other, embodiments and with the various modifications required by the particular applications or uses. Accordingly, the description is not intended to limit it to the form disclosed herein. Also, it is intended that the appended claims be construed to include alternative embodiments.

The invention claimed is:

1. A lubricating oil composition comprising:

a major amount of a base oil of lubricating viscosity; and a polyphosphate-based dispersion comprising an ammonium polyphosphate and a dispersing agent, wherein the ammonium polyphosphate has the following structure:

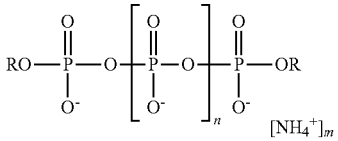

wherein R is independently a hydrogen or a hydrocarbyl group, n is an integer ranging from 1 to 1000, and m is n+2.

2. The lubricating oil composition of claim 1, wherein the dispersing agent is a surfactant.

3. The lubricating oil composition of claim 1, wherein the dispersing agent is a stearate, benzenesulfonate, phosphatidylcholine, alkenyl succinate, oleate, or fatty alcohol.

4. The lubricating oil composition of claim 1, further comprising antioxidant, dispersant, anti-wear agent, detergent, rust inhibitor, dehazing agent, demulsifying agent, friction modifier, metal deactivating agent, pour point depressant, viscosity modifier, antifoaming agent, co-solvent, package compatibilizer, corrosion-inhibitor, dye, or extreme pressure agent.

5. The lubricating oil composition of claim 1, further comprising zinc dithiophosphate.

6. A lubricating oil composition comprising:

a major amount of a base oil of lubricating viscosity;

an ammonium polyphosphate; and a dispersing agent, wherein the ammonium polyphosphate has the following structure:

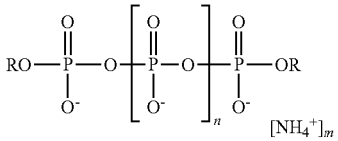

wherein R is independently a hydrogen or a hydrocarbyl group, n is an integer ranging from 1 to 1000, and m is n+2.

7. The lubricating oil composition of claim 6, wherein the dispersing agent is a surfactant.

8. The lubricating oil composition of claim 6, wherein the dispersing agent is a stearate, benzenesulfonate, phosphatidylcholine, alkenyl succinate, oleate, or fatty alcohol.

9. The lubricating oil composition of claim 6, further comprising antioxidant, dispersant, anti-wear agent, detergent, rust inhibitor, dehazing agent, demulsifying agent, friction modifier, metal deactivating agent, pour point depressant, viscosity modifier, antifoaming agent, co-solvent, package compatibilizer, corrosion-inhibitor, dye, or extreme pressure agent.

10. The lubricating oil composition of claim 6, further comprising zinc dithiophosphate.

11. A method of operating an internal combustion engine, the method comprising:

lubricating the engine with a lubricating oil comprising:

a major amount of a base oil of lubricating viscosity;

an ammonium polyphosphate; and a dispersing agent, wherein the ammonium polyphosphate has the following structure:

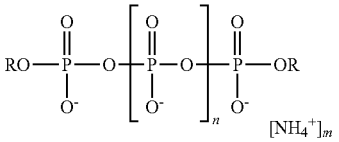

wherein R is independently a hydrogen or a hydrocarbyl group, n is an integer ranging from 1 to 1000, and m is n+2.

12. The method of claim 11, wherein the dispersing agent is a surfactant.

13. The method of claim 11, wherein the dispersing agent is a stearate, benzenesulfonate, phosphatidylcholine, alkenyl succinate, oleate, or fatty alcohol.

14. The method of claim 11, wherein the lubricating oil composition further comprises antioxidant, dispersant, anti-wear agent, detergent, rust inhibitor, dehazing agent, demulsifying agent, friction modifier, metal deactivating agent, pour point depressant, viscosity modifier, antifoaming agent, co-solvent, package compatibilizer, corrosion-inhibitor, dye, or extreme pressure agent.

15. The method of claim 11, wherein the lubricating oil composition further comprises zinc dithiophosphate.

* * * * *